US005322434A

United States Patent [19]

Milewski et al.

[11] Patent Number: 5,322,434

[45] Date of Patent: Jun. 21, 1994

[54] COOLER GRATE

[75] Inventors: Günter Milewski, Ennigerloh; Gerhard Kästingschäfer, Wadersloh; Manfred Strohbusch, Ennigerloh; Gert Tegtmeier, Oelde, all of Fed. Rep. of Germany

[73] Assignee: Krupp Polysius AG, Fed. Rep. of Germany

[21] Appl. No.: 956,809

[22] Filed: Oct. 5, 1992

[30] Foreign Application Priority Data

Oct. 16, 1991 [DE] Fed. Rep. of Germany ..... 4134242

[51] Int. Cl.[5] ..... F27D 15/02

[52] U.S. Cl. ..... 432/78; 110/288; 110/300; 432/235

[58] Field of Search ..... 432/77, 78, 233, 235; 110/288, 300, 310, 311; 62/57; 126/152 B, 163 A, 163 R

[56] References Cited

U.S. PATENT DOCUMENTS

| | | | |
|---|---|---|---|
| 1,910,233 | 5/1933 | Blair | 110/288 |
| 2,112,420 | 3/1938 | Lunda | 110/288 |
| 2,320,410 | 6/1943 | Cheasley | 110/288 X |
| 4,239,029 | 12/1980 | Martin et al. | 126/163 R |
| 4,870,913 | 10/1989 | Schneider | 126/163 R X |
| 5,174,747 | 12/1992 | Massaro, Jr. et al. | 432/78 |

FOREIGN PATENT DOCUMENTS

| | | | |
|---|---|---|---|
| 2011518 | 6/1972 | Fed. Rep. of Germany . | |
| 3812425 | 10/1989 | Fed. Rep. of Germany . | |
| 784409 | 4/1934 | France | 126/163 A |

*Primary Examiner*—William E. Tapolcai
*Attorney, Agent, or Firm*—Learman & McCulloch

[57] ABSTRACT

In this cooler grate according to the invention the supporting surfaces of the grate plates fixed on grate plate supports are provided with cooling gas openings which open upwards and are constructed in the form of substantially endless annular gaps, so that on the one hand a particularly effective cooling of the grate plates and on the other hand a particularly intensive cooling of the material transported over the cooler grate is achieved.

16 Claims, 7 Drawing Sheets

COOLER GRATE

The invention relates to a cooler grate of a grate cooler for hot material. In particular this invention relates to a cooler grate intended for a so-called reciprocating grate cooler.

BACKGROUND

Grate coolers with a cooler grate are known in various forms. For example, DE-AS 20 11 518 discloses a cooler grate construction in which the parts of the individual grate plates through which cooling air streams have ribs which project vertically upwards and define box-shaped troughs, in the bases of which are conical bores which extend vertically for the passage of cooling air.

In another known construction (DE-OS 38 12 425) also the individual grate plates are constructed with troughs open towards the upper face of the supporting surfaces to receive material to be cooled, and here too the cooling gas holes open into the trough region. Moreover, at least some of the cooler grate plates can be constructed with hollow ribs running in the conveying direction for conducting the cooling gas, and the cooling gas holes can be provided in these longitudinally extending hollow ribs.

In the known constructions described above, particularly the constructions of the grate plates belonging to the grate cooler or the cooler grate, it proves difficult to meet some essential requirements all together on such grate plates. For example a favourable production possibility should be guaranteed but it should also be possible to ensure that at the same time an optimum gas distribution is achieved, as well as sufficient cooling of the sections of the supporting surfaces of the grate plate which come into contact with the hot material and also above all an intensive cooling of the material which is transported away over the cooler grate.

The object of the invention, therefore, is to create a cooler grate in which the requirements elucidated above (particularly in the region of the grate plates) can be met all together in a particularly favourable manner.

SUMMARY OF THE INVENTION

In the construction according to the invention the supporting surface of each grate plate has produced in it from above at least one pocket-shaped recess which has on its base at least one window-like through hole (i.e. a correspondingly large free opening) and into which a strip-shaped aeration cap is fitted and arranged in such a way that a cooling air opening in the form of a substantially endless annular gap is constructed. This produces within each grate plate a cooling gas passage through which practically all regions of the sections of supporting surface which come into contact with hot material (e.g. hot cement clinker coming from a kiln) can be optimally cooled by an air speed which is chosen to be appropriately high in the annular gap. The cooling gas emerging from these annular openings also passes over the lateral surfaces of the annular gap regions and thus ensures an addition heat abduction on the lower region of the grate plates.

The cooling gas resistance can be predetermined in the manner which is necessary in each case by the gap width of the cooling gas openings. In this case it can also be ensured above all that for the cooling of the grate plates or of their supporting surfaces themselves the cooling gas is delivered at a sufficiently high speed, whilst on the other hand the cooling gas speed in the region in which the cooling gas enters the material to be cooled can be reduced so markedly that an optimum gas distribution in the material and thus a particularly intensive cooling of the hot material is facilitated.

In this extremely favourable means of guiding the cooling gas through the cooling gas openings in the shape of annular gaps, the multi-part construction of each grate plate (which in each case is formed from the base or main element of the plate and at least one aeration cap which is appropriately constructed and arranged) has also proved particularly advantageous from the production point of view if these plate parts are produced as castings. In this connection, if for instance the known construction according to DE-OS 38 12 425 which is described above is considered by comparison, then it will be established that in the grate plate of the disclosure which is clearly of completely integral construction it is difficult to produce defined passage cross-sections for the cooling gas openings in one casting operation.

THE DRAWINGS

The invention will now be explained in greater detail below with the aid of some embodiments which are illustrated in the accompanying drawings. In the drawings.

DETAILED DESCRIPTION

Figure 1:
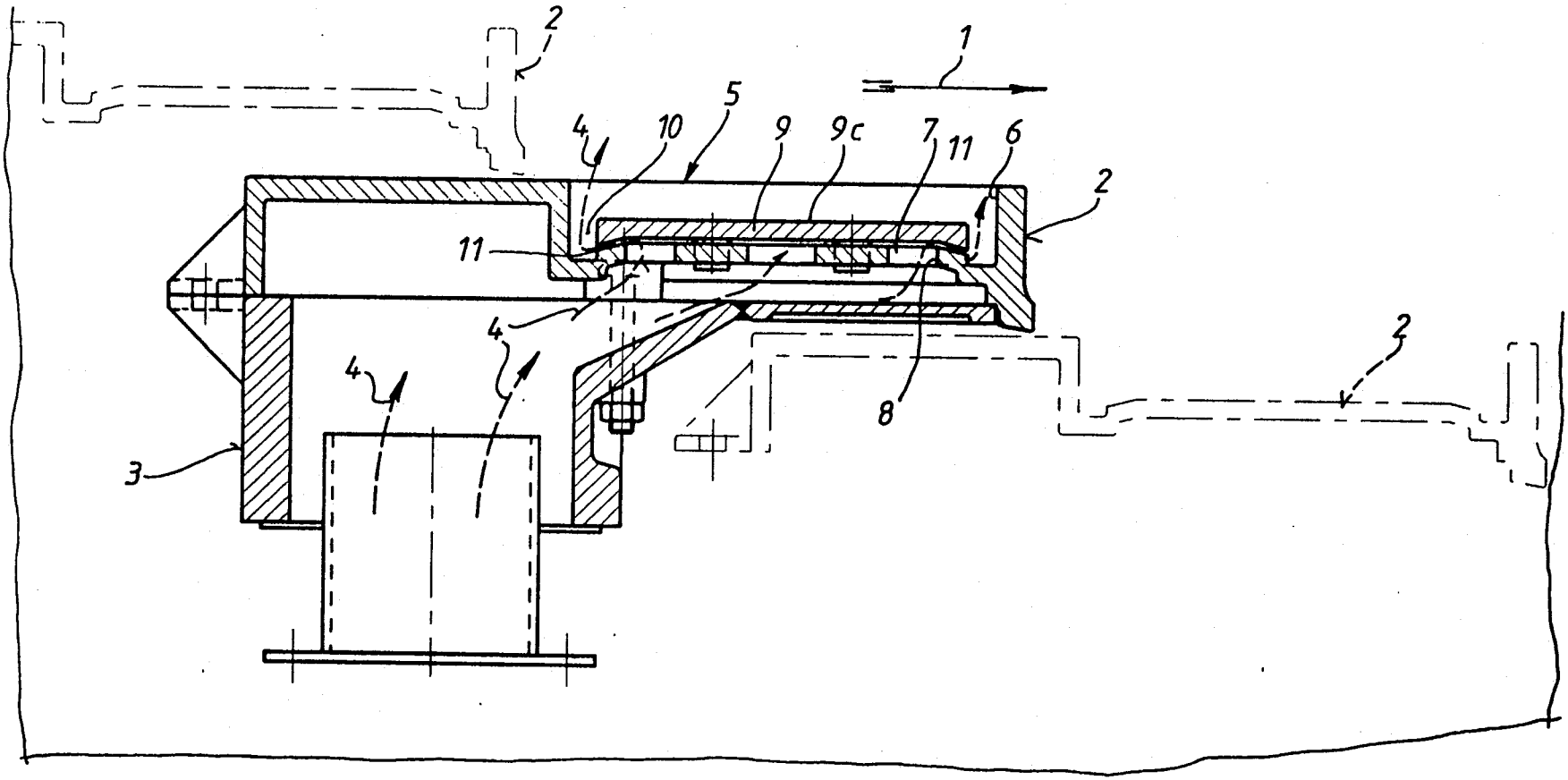
FIG. 1 shows a partial longitudinal sectional view through a cooler grate according to the invention.

The general construction of the cooler grate according to the invention will be explained first of all with the aid of FIG. 1. For the sake of simplicity and clarity only those parts of this cooler grate which are necessary for explanation of the invention are shown. In its entirety this cooler grate belongs to a grate cooler, particularly a reciprocating grate cooler, which is intended for cooling hot material, such as for example hot cement clinker coming out of a preceding kiln, the material to be cooled being transported in the longitudinal direction, i.e. in the direction of the arrow 1 over the cooler grate.

In a manner which is known per se, this cooler grate contains a plurality of rows of grate plates 2 which adjoin one another in the longitudinal direction and overlap one another. The grate plates of each row lie adjacent to one another in groups in the cross-direction of the grate and are in each case fixed on a grate plate support 3 which extends obliquely with respect to the grate, only one of these grate plate supports 3 being shown in FIG. 1. This grate plate support 3 is constructed as a hollow body for the supply of cooling gas (arrows 4) from below, and is connected to a cooling gas chamber or source which is not shown in greater detail; cooling air can be used—as is known per se—as the cooling gas.

Each grate plate 2 has a supporting surface 5 over which the material to be cooled is transported along.

Figure 2:
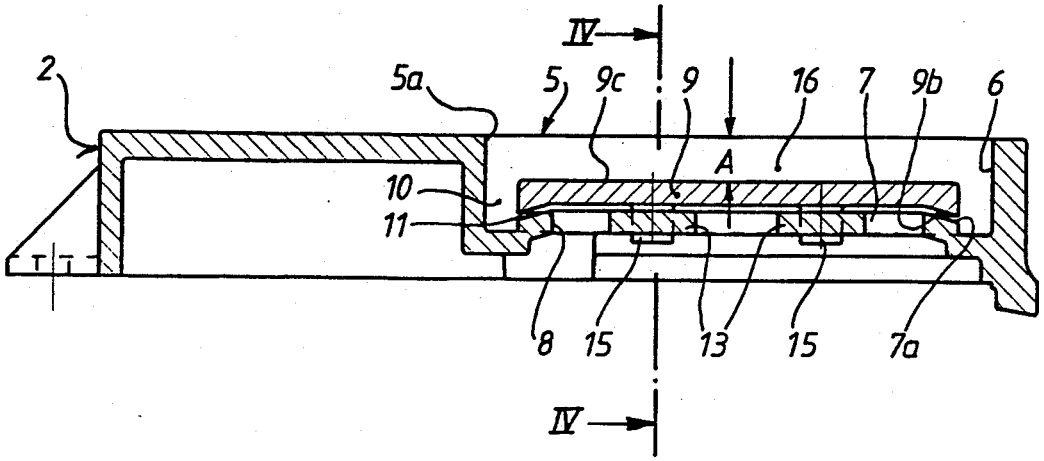
FIG. 2 shows a longitudinal section through a grate plate of this cooler grate, approximately along the line II—II in FIG. 3.
Figure 3:
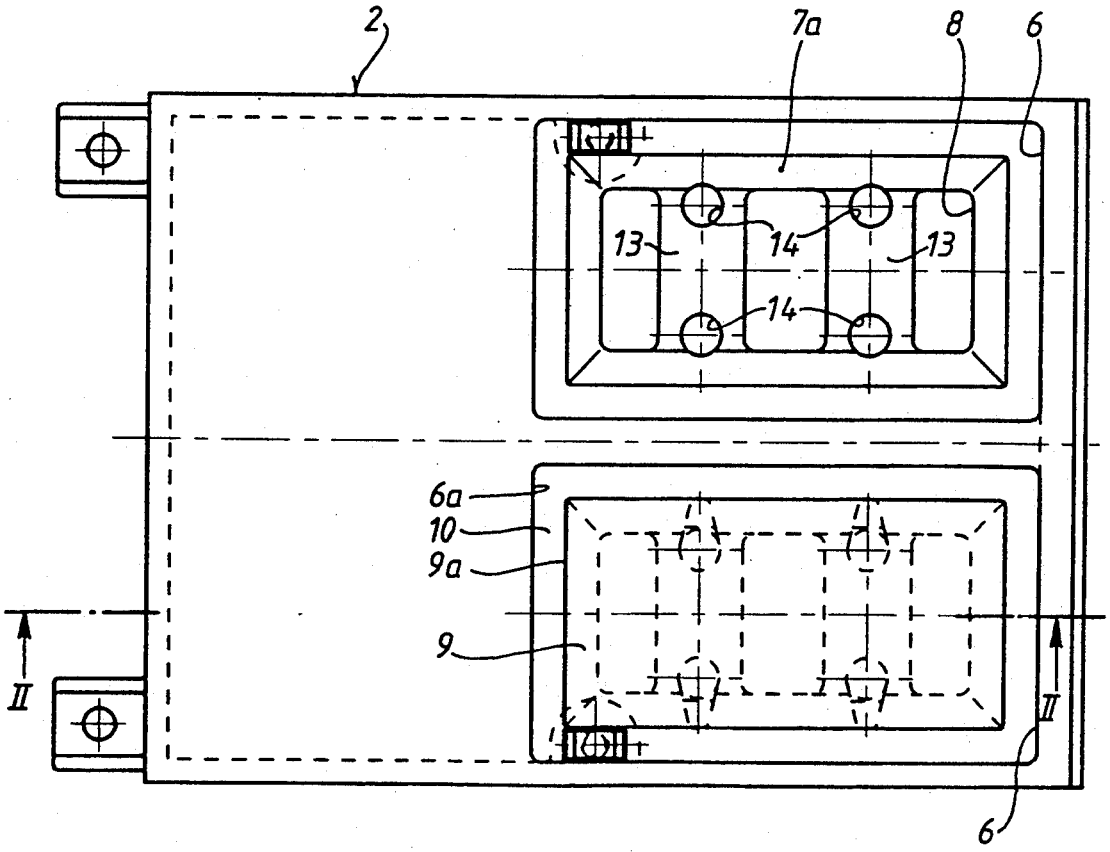
FIG. 3 shows a top view of the grate plate according to FIG. 2 (in which an aeration cap is removed)

As can be seen on the central grate plate 2 in FIG. 1 and more clearly in FIGS. 2 to 3, at least one pocket-shaped recess 6 which has at least one relatively large free window-like through hole 8 in its base 7 is produced from above in the supporting surface 5 of each grate plate 2. In the first embodiment illustrated in FIGS. 1 to 4 two pocket-shaped recesses 6 are preferably provided in the grate plate 2 or the supporting surface 5 thereof. Furthermore, a strip-shaped aeration cap 9 is fitted and arranged in each recess 6 in such a way that cooling gas openings 10 in the form of substantially endless annular gaps are constructed which open towards the upper face of the supporting surfaces 5, i.e. these cooling gas openings 10 shaped like annular gaps are defined on the one hand towards the exterior by the approximately upright inner faces 6*a* of the pocket-shaped recesses 6 and on the other hand by the outer peripheral edge 9*a* of the aeration caps 9.

Figure 5:
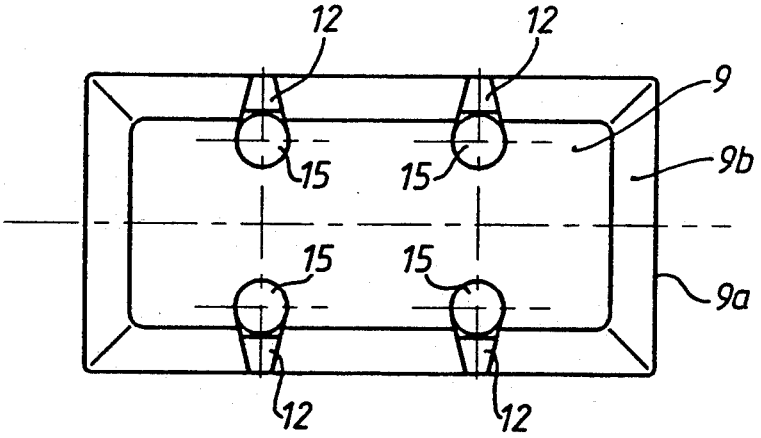
FIG. 5 shows an underneath view merely of an aeration cap.

It is also important that between the underside edge region 9*b* of each aeration cap 9 and the edge region 7*a* of the recess base 7 lying opposite this edge region a cooling gas inlet slot 11 is constructed which also runs round in a substantially annular shape, and the internal width of this slot can be determined by the arrangement of several appropriately distributed distance pieces 12. These distance pieces 12 are preferably attached integrally in appropriate distribution to the underside of each aeration cap 9, as indicated in FIG. 5.

Figure 4:
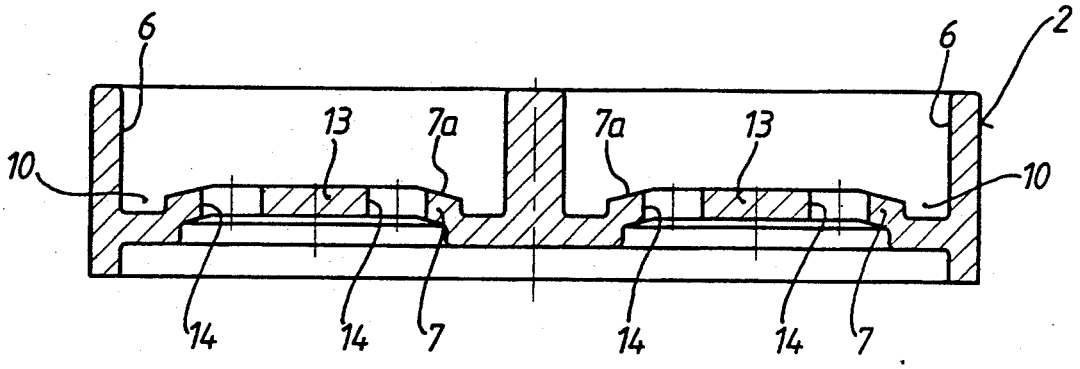
FIG. 4 shows a cross-section through the grate plate corresponding to the section line IV—IV in FIG. 2.

As can be seen in FIGS. 1, 2 and 4, it is preferred that the central section of the base 7 of each supporting surface recess 6 which is covered by the appertaining aeration cap 9 should be raised relative to the rest of its peripheral edge surface, that is to say the edge surface lying below the appertaining cooling gas opening 10 in the form of an annular slot. The peripheral edge region 7*a* of the base 7 which has already been mentioned above is constructed on this raised central base section, preferably in such a way that—viewed in the cross-section of the grate plate 2—it is inclined outwards and downwards in the direction of the lower section of the appertaining cooling gas opening 10 in the form of an annular slot. The lower or underside edge region 9*b* of the appertaining aeration cap 9 is also inclined outwards and downwards over the entire periphery corresponding to this inclination of the peripheral edge 7*a*. In this way the cooling gas inlet slot 11 which is constructed between these two peripheral edge regions 7*a* and 9*b* which lie spaced opposite one another is also—when viewed in vertical section through the grate plate 2—inclined downwards in the direction of entry of the cooling gas (arrows 4 in FIG. 1 ) in such a way that it opens over its entire periphery into the lower section of the appertaining cooling gas opening 10 in the form of an annular slot (cf. FIGS. 1 and 2). By means of this construction and arrangement of the cooling gas inlet slots 11 (in cooperation with the cooling gas openings 10 as well as a corresponding cooling gas speed) it can be reliably ensured that no fine particles of the material to be cooled can fall downwards through the grate plate 2 or the cooling gas openings 10 thereof.

In the upper recess 6 in FIG. 3 which is not covered by a cap 9 and also above all in the sectional representations in FIGS. 2 and 4 it can be seen that the relatively large window-like through hole 8 in the base 7 of each recess 6 has supporting bars 13 which extend transversely and have several bores 14. These bores 14 are intended to receive fixing bolts 15 which each aeration cap 9 has on its underside. These downwardly projecting fixing bolts 15 are inserted into the holes 14 in the supporting bars 13 of the raised base section to such a distance that they are fixed, preferably welded, at the advantageous height of the cap 9. Thus this height of the cap relative to the raised section of the recess base 7 which lies below it also determines the internal width of the cooling gas inlet slot 11 which runs round in an annular shape, as can be readily seen in FIGS. 1 and 2.

The aeration caps 9 all have a substantially flat upper face. In the preferred embodiment of the grate plate 2 which is illustrated in these FIGS. 1 to 4 the arrangement of the raised central section of the base 7 and the aeration cap 9 is such that the upper face 9*c* of the cap 9 lies lower than the upper face of the upper plane 5*a* of the supporting surface 5 by the dimension A (FIG. 2). In this way an aerating pocket 16 is constructed in the appertaining recess 6 additionally in the region above the aeration cap 9, and during the cooling of the cooler grate or the grate cooler this aerating pocket 16 can fill with material and thus can protect this region of the grate plate 2 or supporting surface 5 particularly advantageously against wear. These aerating pockets 16 provide a further advantage during the cooling operation in that in these aerating pockets above the caps 9 the cooling gas escaping upwards out of the annular gaps 10 forms a sort of turbulence bed of the material included there which then enters with a relatively large surface area into the cooling material bed located above it and thus favours optimum cooling of the material.

In general the cooling gas openings 10 which are defined by the recesses 6 and the aeration caps 9 can have any suitable shape in the form of an elongated annular gap extending in the direction of conveying the material for cooling (arrow 10) so long as it ensures that the cooling gas passes or escapes over the greatest possible surface area from the grate plate 2 into the bed of material for cooling. However, in the tests on which the invention is based it has proved particularly advantageous if the recesses 6 and the aeration caps 9 placed therein have an elongated rectangular shape in such a way that the annular gaps which form the cooling gas openings 10 have an elongated rectangular shape (cf. Fig. 3) which is endless in the top view of the supporting surface 5, the long sides of the rectangle running substantially parallel to the conveying direction (arrow 1) of the material to be cooled.

As regards the number of recesses 6 with appertaining aeration caps 9 in each supporting surface 5 or grate plate 2, this number generally depends upon the particular size of the plates (base surface); however, in the case of the grate plate sizes which have been usual in the art until now it has proved particularly favourable to provide two recesses 6/aeration caps 9 co-ordinated with the supporting surface 5 and thus two correspondingly large cooling gas openings 10 which run around in the form of an annular gap. In this connection it should also be mentioned that—as can also be seen in FIGS. 1 to 3—the recesses 6 with their aeration caps 9 are arranged only in the larger long section of the grate plate 2 which is at the front in the material conveying direction (arrow 1) and which is not passed over by the grate plates 2 lying above it during the reciprocating movement to and fro of the rows of grate plates (in this connection cf the representation in FIG. 1).

A second embodiment of the construction of grate plates for the cooler grate according to the invention will be described first of all with the aid of FIGS. 6 and 7. Here, too, it may be assumed in a preferred manner that the grate plate 2' or its supporting surface 5' has on its front long section pointing in the material conveying direction (arrow 1) two evenly distributed cooling gas or cooling air openings 10' which open towards the upper face of the supporting surface 5' and are in turn constructed in the form of substantially closed annular gaps. Here too it may be assumed that with adapted size and elongated rectangular shape two such cooling gas openings 10' in the form of annular gaps are correspondingly evenly distributed and adapted to the size of the surface.

Moreover, here too the cooling gas openings 10' in the form of annular gaps are formed in that two pocket-shaped recesses 6' are worked from above into the supporting surface 5' of the grate plate 2' and have several through holes 8' on their base 7' and a strip-shaped aeration cap 9' is fitted and arranged in each recess 6' forming the said annular gap. However, in contrast to the first example described above, in this case each aeration cap 9' has a flat upper face which lies flush with the upper face of the supporting surface 5' (cf. FIG. 7).

Figure 7:
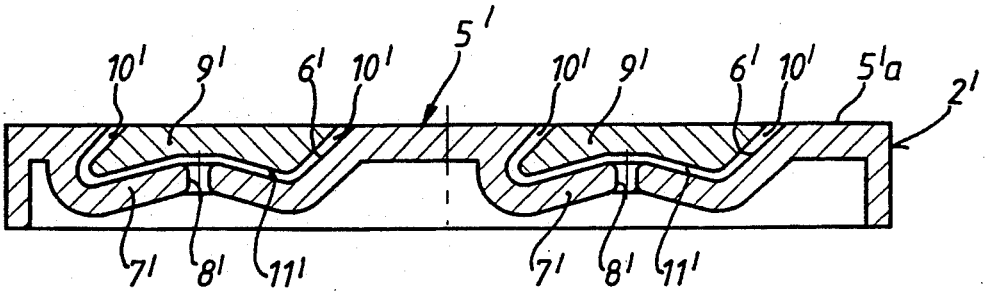
FIG. 7 shows a cross-sectional view along the line VII—VII in FIG. 6.
Figure 6:
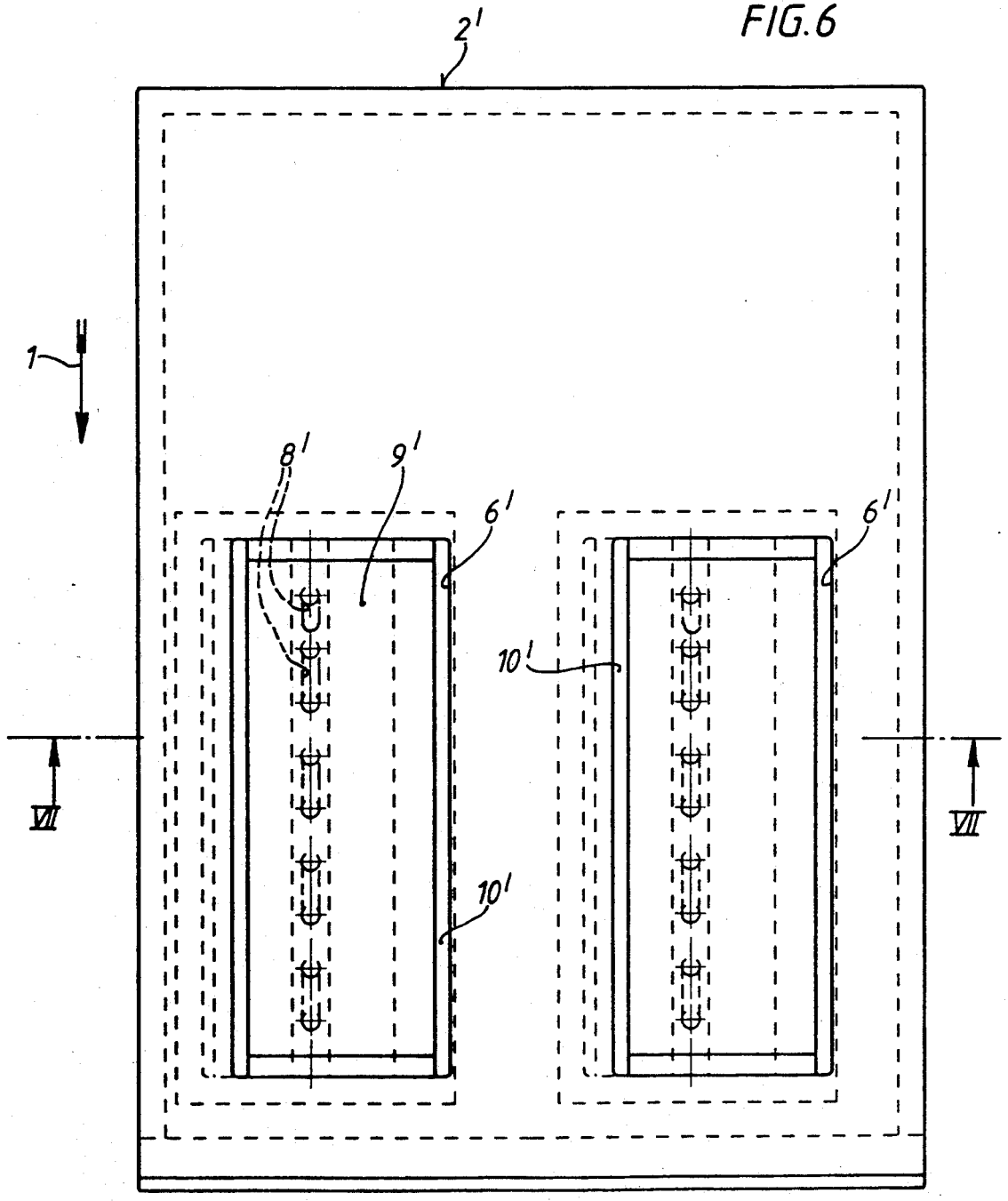
FIG. 6 shows a top view of another embodiment of a grate plate.

Whereas in the first embodiment (particularly FIGS. 1 to 4) the cooling gas openings 10 in the form of annular gaps are aligned substantially perpendicular or vertical with respect to the upper face 5*a* of the supporting surfaces 5, FIGS. 6 and 7 show a construction in which the longitudinal sections of the rectangular cooling gas openings 10' in the form of annular gaps which extend in the conveying direction (arrow 1) of the material to be cooled are inclined with respect to the vertical, i.e. all the longitudinal sections of the cooling gas openings 10' in the form of annular gaps of one grate plate 2' are inclined in one direction at approximately the same angle with respect to the vertical (cf. cross-section in FIG. 7).

In this construction of the cooling gas openings 10' it is also provided—again in a similar, suitably adapted manner—that between the underside edge region of each aeration cap 9' and the opposite edge region of the recess base 7' a cooling gas inlet slot 11' is constructed which runs around in a substantially annular shape and can be predetermined and set in its internal width according to the particular requirements. Here too—as shown in the cross-section in FIG. 7—the cooling gas inlet slot 11' can be inclined downwards in the cooling gas inlet direction and can open largely without a transition into the lower section of the appertaining gas opening 10' which is in the form of an annular gap.

Figure 8:
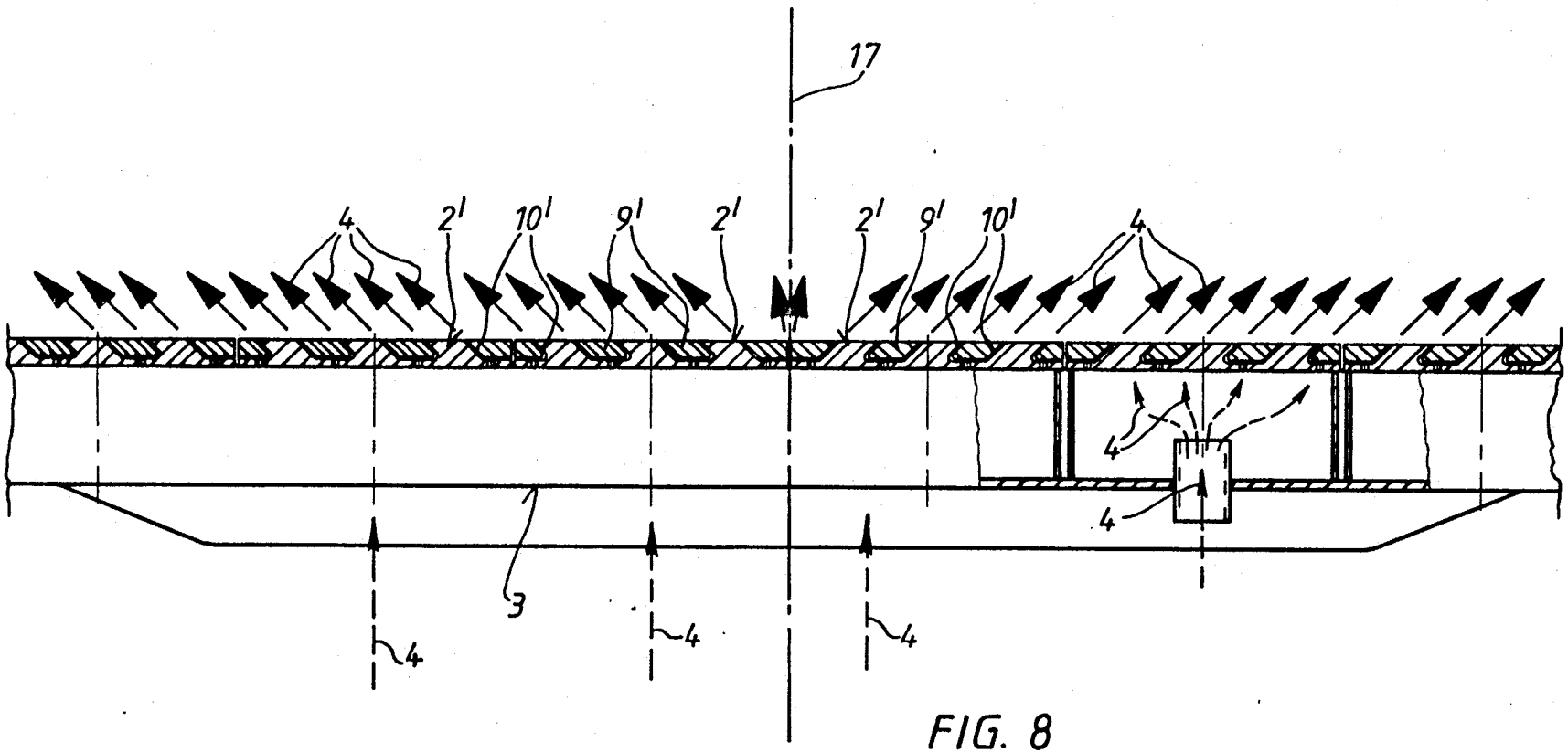
FIG. 8 shows a largely schematic partial cross-sectional view of a grate plate support which extends obliquely and has several grate plates arranged on it.

Moreover, FIG. 8 shows a partial cross-sectional view of a grate plate carrier 3' which is again constructed as a hollow body, is constructed for the delivery of cooling gas from below and bears on its upper face a row of grate plates—for example constructed as in FIGS. 6 and 7—which are placed adjacent to one another in the cross-direction. Here, as in the first example according to FIG. 1, the grate plates 2' (or 2 respectively) can be constructed and fixed on the grate plate supports 3' (or 3) in such a way that the cooling gas (broken arrows 4) can flow freely from below at least onto the base 7' (or 7) of the recesses 6' (or 6) and the aeration caps 9' (or 9) arranged above them.

Furthermore, if it is assumed that grate plates 2' of the construction described with the aid of FIGS. 6 and 7 are fixed on the grate plate support 3' according to FIG. 8, then these grate plates 2' are preferably co-ordinated in such a way that—viewed in the cross-section of the cooler grate and starting in each case from the vertical longitudinal central plane 17—the longitudinal sections of the cooling gas openings 10' located on the two transverse halves of this cooler grate are each inclined with respect to the outer longitudinal side of the cooler grate lying nearest.

In this way the cooling gas (indicated by arrows 4 in FIG. 8) coming upwards out of the cooling gas openings 10' can to a considerable extent enter the material to be cooled in the cross-direction to the material conveying direction (arrow 1 in FIG. 3 or at right angles to the drawing plane of FIG. 8).

In all constructions of grate plates and possible means of co-ordination with the grate plate support it is advantageous for the internal width of the cooling gas slots 11, 11' to be chosen so that approximately equal quantities of cooling gas can be delivered to the grate plates 2, 2' which are supplied with cooling gas through a grate plate support section, i.e. the delivered quantities of cooling gas can be evenly distributed over the corresponding grate plates.

In this construction according to the invention above all of the grate plates and in particular of the grate plates 2 according to the embodiment explained with the aid of FIGS. 1 to 5, a kind of three-way division of the cooling gas control can be brought about in an advantageous manner, namely in the first case a relatively high gas speed (for example approximately 40 m/s) in the region of the cooling gas inlet slots 11, in the second case a gas speed (approximately in the range from 12 to 15 m/s) which is correspondingly reduced by contrast therewith by the larger opening cross-section in the region of the cooling gas openings 10 in the form of annular gaps, and in the third case a gas speed which is very drastically reduced in the region of the aerating pockets 16 and amounts to only a few m/s (possibly only slightly more than 0). By means of this three-stage cooling gas control it is ensured that the supporting surface sections of each grate plate 2 which come into contact with hot material are sufficiently cooled, any penetration of fine material particles into the cooling gas inlet slots is prevented and optimum distribution of the cooling gas flowing out upwards is achieved in the material to be cooled (material bed) and thus an optimum very intensive cooling effect is achieved.

Within the scope of the invention the embodiments which have been described above can be varied in a meaningful way, always maintaining the basic principles of this cooler grate according to the invention, particularly the appertaining grate plates, which are described above. Some of these possible variants will be explained below with the aid of FIGS. 9 to 14.

Figure 9:
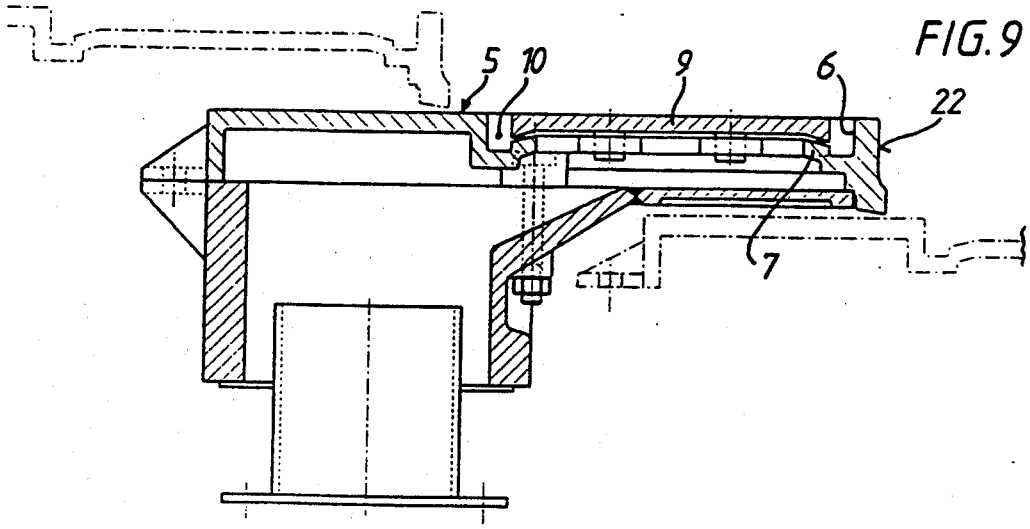
FIG. 9 shows a longitudinal section similar to FIG. 2 but through a flat grate plate.

In FIG. 9 an embodiment is illustrated in which the individual grate plates 22 largely correspond in construction to the construction of the embodiment explained with the aid of FIGS. 1 to 5, so that all similar grate plate parts are given the same reference numerals. Thus here, too, two similar pocket-shaped recesses 6 are preferably made in the supporting surface 5 of the grate plate 22 and a strip-shaped aeration cap 9 is again arranged on the base 7 of each of these recesses in such a way that a cooling gas opening 10 is produced in the form of a closed annular gap. The special feature of this variant is to be seen in the fact that each of these grate plates 22 is of substantially flat construction and has no special aerating pocket (cf. aerating pocket 16 in FIG. 2), i.e. in these grate plates 22 each substantially flat upper face of the aeration cap 9 lies flush with the upper face of the supporting surface 5 (approximately similar to the second embodiment described with the aid of FIG. 7).

Figure 10:
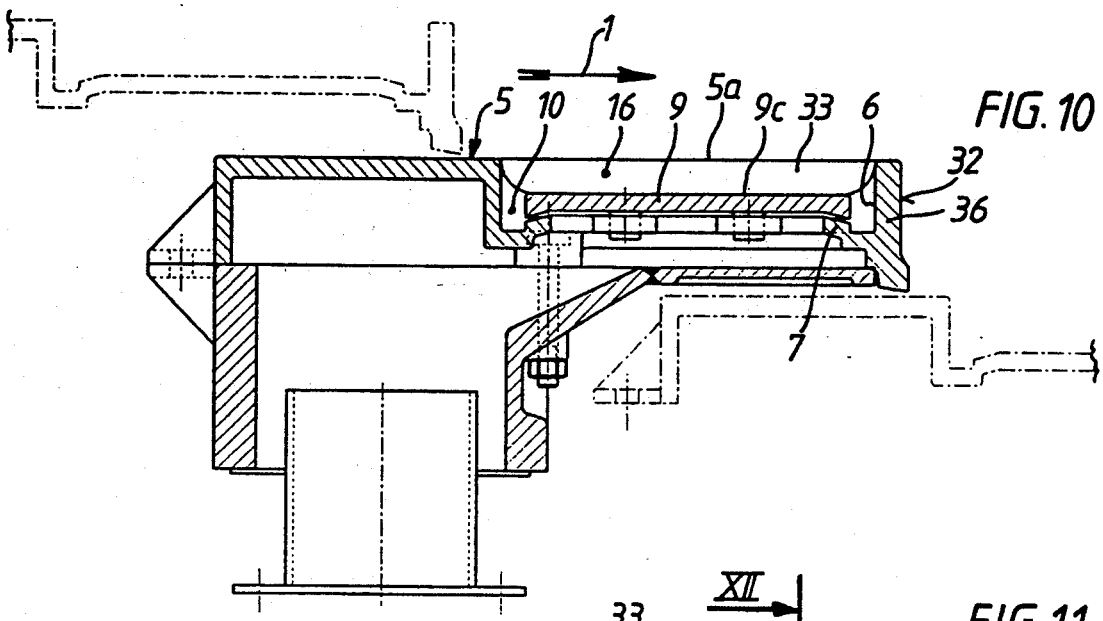
FIGS. 10, 11 and 12 show a longitudinal section, top view and cross-sectional view respectively of a further variant of the grate plate.
Figure 11:
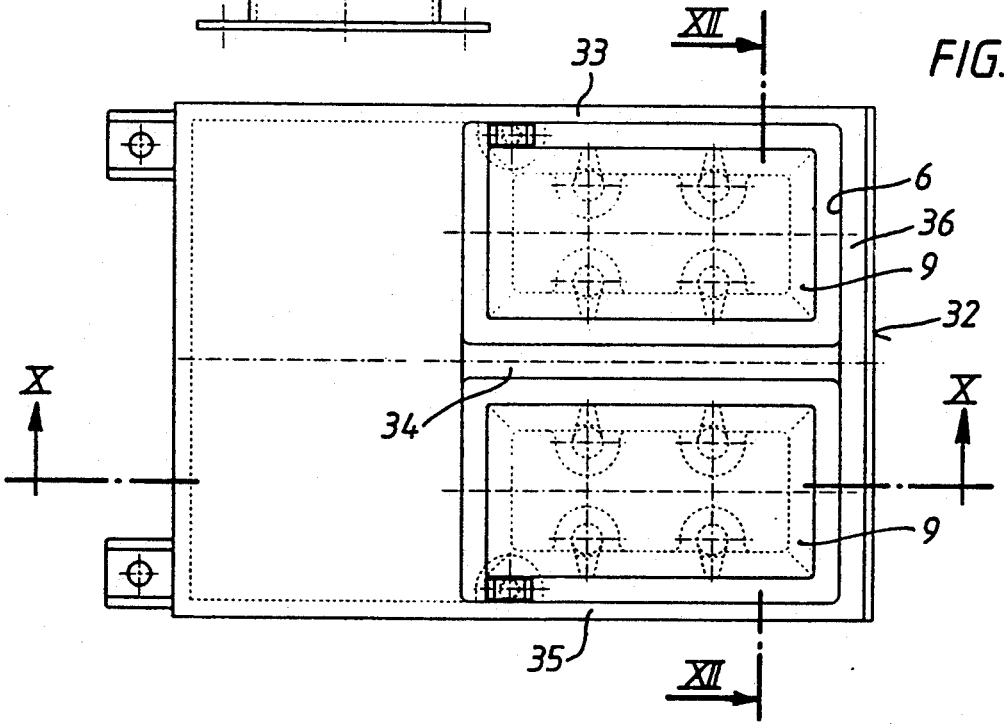
Figure 12:
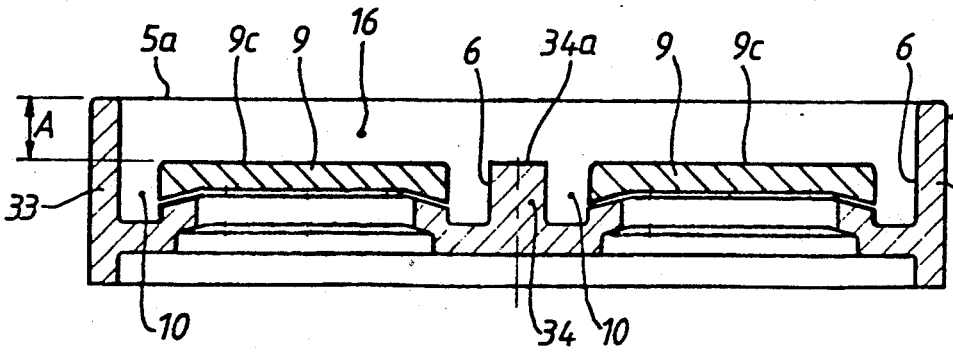

The further variant which is illustrated in FIGS. 10, 11 and 12 is also based on the basic construction of the first embodiment as described with the aid of FIGS. 1 to 5, so that here too the same grate plate parts are given the same reference numerals. In this case it can be seen particularly with the aid of FIGS. 11 and 12 that here too two pocket-shaped recesses 6 of equal size are made in the supporting surface of each of the grate plates 32 which are shown here, a strip-shaped aeration cap 9 is fitted into each recess and arranged on the base 7 in such a way that in each case a cooling gas opening 10 is produced in the form of a closed annular gap. Furthermore, here too the substantially flat upper face 9*c* of each aeration cap 9 is lower than the upper face 5*a* of the supporting surface 5 by a dimension A (as in the first embodiment according to FIGS. 1 to 5), additionally forming an aerating pocket.

In the case of this variant, if the sketches in FIGS. 10 to 12 are considered then it becomes particularly clear here that each recess 6 is defined above all by two longitudinal bars, namely the bars 33, 34 on the one hand and the bars 34, 35 on the other hand, which are arranged spaced from one another and extend parallel to one another and to the material conveying direction (arrow 1), as well as an end bar 36 which is at the front when viewed in the material conveying direction (arrow 1) and extends obliquely over the entire grate plate 32. This variant according to FIGS. 10 to 12 differs from the first embodiment (cf. in particular FIG. 4) principally in that in addition to the end bar 36 the two outer longitudinal bars 33 and 35 also extend to the height of the upper edge 5*a* of the supporting surface, thus forming a common aerating pocket 16 which is approximately box-shaped, whilst the upper edge 34*a* of the central longitudinal bar 34 is approximately at the height of the upper faces 9*c* of the two aeration caps 9. Thus in this embodiment the central longitudinal bar 34 is reduced in height relative to the other longitudinal bars 35, 36.

Figure 13:
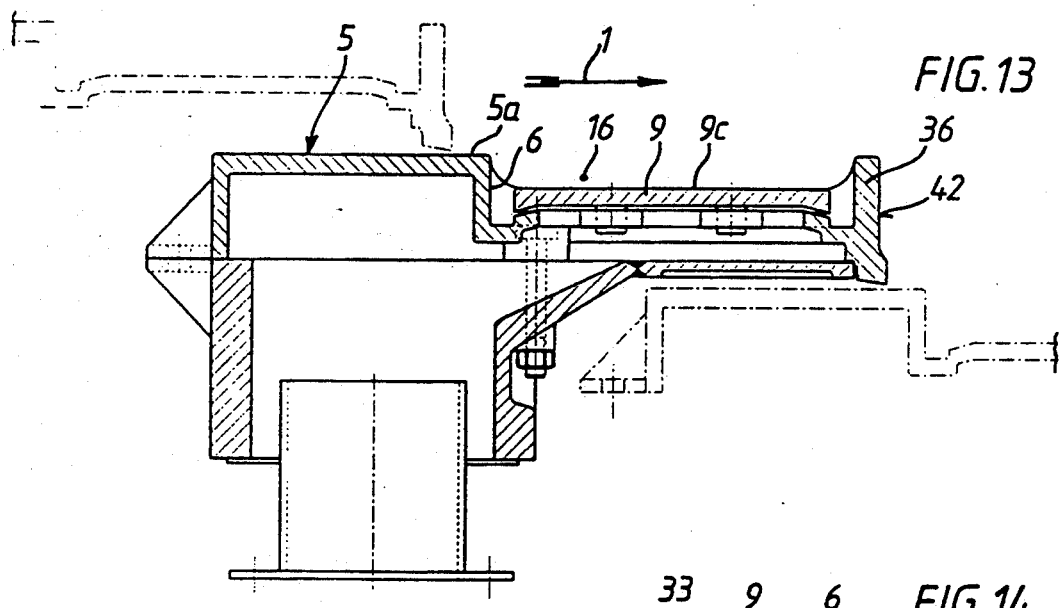
FIGS. 13 and 14 show a longitudinal sectional view and a top view of another variant of the grate plate.
Figure 14:
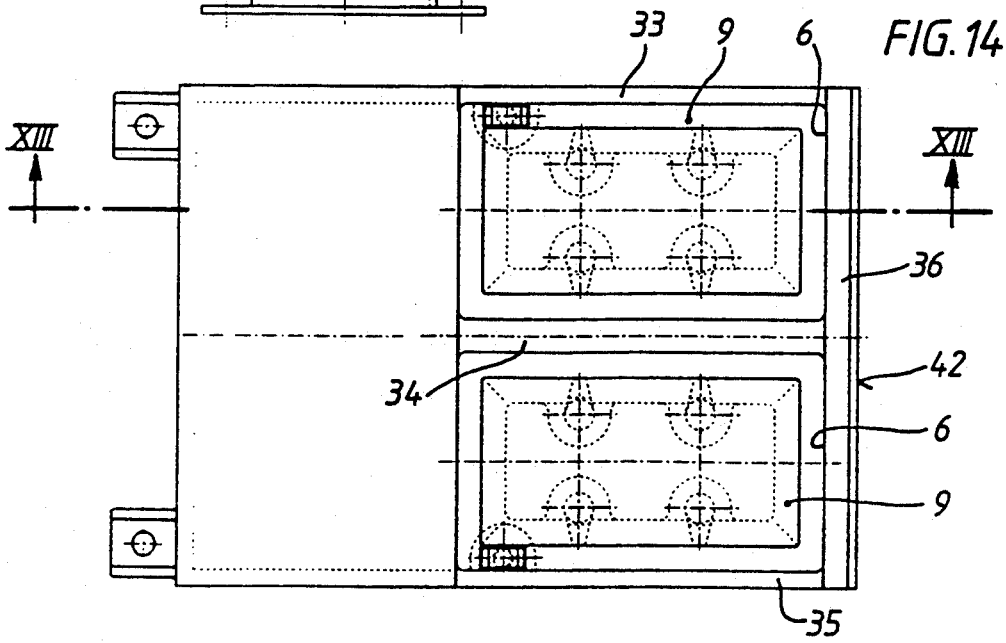

The variant of grate plates 42 illustrated with the aid of FIGS. 13 and 14 also relates to the construction of the aerating pockets 16 in the region above the aeration caps 9. If in this connection the preceding explanations with the aid of FIGS. 10 to 12 are taken up, then in this variant according to FIGS. 13 and 14 only the front end bar 36 extends to the height of the upper face 5*a* of the supporting surface to form the aerating pocket 16. By contrast, all the longitudinal bars 33, 34 and 35 which run in the material conveying direction (arrow 1) only extend to the height of the upper faces 9*c* of the aeration caps 9, i.e. their upper edges lie approximately in the same plane as the upper faces of these aeration caps 9. Thus the aerating pocket 16 in this variant is defined principally by the front end bar 36 and, of course, also by the rear—when viewed in the material conveying direction (arrow 1)—raised portion (cf. supporting surface 5) of these grate plates 42, as can be seen from FIG. 13.

Moreover, in a further embodiment of these two last-mentioned variants (according to FIGS. 10 to 12 and FIGS. 13 and 14) it is also possible that of the two outer longitudinal bars 33 and 35 only one outer longitudinal bar (35 or 36) extends to the height of the upper face 5*a* of the supporting surface, whilst the other outer longitudinal bar and the central longitudinal bar lie with their upper edges approximately at the height of the upper face 9*c* of the aeration cap 9. This further variant is particularly sensible when grate plates 42 according to FIGS. 13 and 14 are arranged over the greater part of the width of the grate (that is to say in the cross-direction of the grate), whereas in the last-mentioned variant only the outer one of the longitudinal bars is taken up to the height of the upper face 5*a* of the supporting surface which is adjacent to an outer long side of the cooler grate, so that none of the material for cooling accumulated on the grate plate or in the aerating pocket 16 thereof can fall out.

With regard to the longitudinal bars which are reduced in height according to the embodiments described with the aid of FIGS. 10 to 14 it should also be mentioned that advantages can be achieved thereby in so far as bars which are reduced in height come into contact with hot material for cooling to a much lesser extent and therefore are only subjected to a lower thermal load and less abrasion. Furthermore, bars which are reduced in height in this way can also be produced, particularly cast, at lower cost.

The additional variants which have been explained also make it clear that the grate plates constructed according to the invention and thus also the cooler grate according to the invention can be adapted in an extremely advantageous manner to the different operating conditions and materials for cooling.

We claim:

1. A grate construction for use with reciprocable grate cooler apparatus for cooling hot material, said grate construction comprising:

a plurality of grate plates;

grate plate supports supporting said grate plates;

each of said grate plates having an upper support surface for supporting the hot material as the material is conveyed across said upper support surface in response to reciprocation of said grate cooler apparatus;

at least one recess in each of said support surfaces of said grate plates, each recess having a base at a level below that of said support surface and an upright side wall face extending upwardly to a level above that of said base, said base having at least one through-hole for the passage of cooling gas;

and an aeration cap having an uninterrupted upper surface supported within said recess in spaced relationship to said side wall face of said recess thereby defining an annular cooling gas opening encircling said cap, said gas opening communicating with said through-hole and through which the cooling gas is directed for cooling the material as said material is conveyed across said upper support surfaces.

2. The construction of claim 1 wherein an underside edge region of each aeration cap is supported in spaced relationship above an opposite edge region of the base of each recess by distance pieces thereby forming a cooling gas inlet slot therebetween.

3. The construction of claim 2 wherein said cooling gas inlet slot has an annular outlet gap opening into said cooling gas opening, said inlet slot being inclined downwardly in the direction of entry of the cooling gas into said cooling gas opening.

4. The construction of claim 3 wherein each aeration cap includes a plurality of bolts projecting downwardly from said underside of said cap and extending through corresponding holes in said base of said recess for fixing on said recess base.

5. The construction of claim 1 wherein the upper surface of each aeration cap is substantially flat and lies below said support surface of said grate plate forming an aerating pocket.

6. The construction of claim 5 wherein each recess is defined by two longitudinal bars which are arranged in spaced parallel relationship to one another extending in a material conveying direction, and an end bar extending upwardly to said upper support surface forming said aerating pocket.

7. The construction of claim 6 wherein each grate has at least two recesses and said longitudinal bars extending upwardly to said support surface forming an aerating pocket common to both recesses.

8. The apparatus of claim 6 wherein each grate has at least two recesses and said longitudinal bars and a central longitudinal bar extend upwardly to said supporting surface forming said aerating pocket.

9. The apparatus of claim 6 wherein one of said longitudinal bars adjacent an outer long side of said cooler grate extends upwardly to said supporting surface.

10. The construction of claim 1 wherein each aeration cap has a substantially flat upper face flush with the upper support surface.

11. The construction of claim 1 wherein said cooling gas opening has an elongated rectangular shape having long sides extending substantially parallel to the direction of material movement.

12. The construction of claim 1 wherein each grate plate includes at least two of said recesses each having an associated one of said aeration caps accommodated therein.

13. The construction of claim 2 wherein said grate plate supports are hollow and secured in fluid-tight relation to said grate plates for delivering cooling gas through said grate plate supports to said grate plate and aeration cap.

14. The construction of claim 13 wherein said cooling gas inlet slots have a predetermined width selected for even distribution of cooling gas to said plurality of grate plates.

15. The construction of claim 13 wherein said cooling gas openings are substantially perpendicular to said upper support surfaces.

16. The construction of claim 13 wherein longitudinal sections of said cooling gas openings are inclined with respect to the vertical.

* * * * *